US008235609B2

(12) United States Patent
Chuang

(10) Patent No.: US 8,235,609 B2
(45) Date of Patent: Aug. 7, 2012

(54) SELECTABLE PRINTHEAD-TO-PAPER SPACING ADJUSTMENT METHOD

(75) Inventor: Siew Pern Chuang, Singapore (SG)

(73) Assignee: Eastman Kodak Company, Rochester, NY (US)

( * ) Notice: Subject to any disclaimer, the term of this patent is extended or adjusted under 35 U.S.C. 154(b) by 524 days.

(21) Appl. No.: 12/492,496

(22) Filed: Jun. 26, 2009

(65) Prior Publication Data

US 2010/0328372 A1 Dec. 30, 2010

(51) Int. Cl.
*B41J 11/20* (2006.01)

(52) U.S. Cl. ..... 400/58; 400/59; 347/8

(58) Field of Classification Search ..... 347/8, 19, 347/5, 9; 400/58, 59
See application file for complete search history.

(56) References Cited

U.S. PATENT DOCUMENTS

| | | | | |
|---|---|---|---|---|
| 5,368,403 | A | 11/1994 | Broder et al. | 400/352 |
| 5,414,453 | A | 5/1995 | Rhoads et al. | 347/8 |
| 5,838,338 | A | 11/1998 | Olson | 347/8 |
| 6,543,868 | B2 | 4/2003 | Cooper et al. | 347/8 |
| 6,565,272 | B2 | 5/2003 | Kelley et al. | 400/59 |
| 6,616,354 | B2 | 9/2003 | O'Hara et al. | 400/56 |
| 6,629,787 | B2 * | 10/2003 | Lee et al. | 400/59 |
| 6,663,302 | B2 | 12/2003 | Kelley et al. | 400/59 |
| 6,666,537 | B1 | 12/2003 | Kelley et al. | 347/8 |
| 6,672,696 | B2 | 1/2004 | Fairchild et al. | 347/8 |
| 7,040,819 | B2 * | 5/2006 | Takeshita et al. | 400/58 |
| 7,303,246 | B2 | 12/2007 | Buonerba et al. | 347/8 |
| 7,434,190 | B2 | 10/2008 | Koh et al. | 347/8 |

* cited by examiner

*Primary Examiner* — Lam S Nguyen
(74) *Attorney, Agent, or Firm* — Eugene I. Shkurko

(57) ABSTRACT

A method of adjusting the spacing between a portion of a printhead and a portion of a media support in a printing system. The spacing is easily adjustable at least at the time of manufacture for locking a printhead at a selected distance from the media support. A rotatable variable spacer is abutted against an anti-rotation rail to lock into place the printhead at the selected distance.

25 Claims, 17 Drawing Sheets

SELECTABLE PRINTHEAD-TO-PAPER SPACING ADJUSTMENT METHOD

CROSS-REFERENCE TO RELATED APPLICATION

U.S. patent application Ser. No. 12/492,578 entitled: "SELECTABLE PRINTHEAD-TO-PAPER SPACING ADJUSTMENT APPARATUS", filed concurrently herewith, is assigned to the same assignee hereof, Eastman Kodak Company of Rochester, N.Y., and contains subject matter related, in certain respect, to the subject matter of the present application. The above-identified patent application is incorporated herein by reference.

FIELD OF THE INVENTION

This invention relates generally to the field of carriage printers, and more particularly to a method for adjustment of the spacing between the printhead and the recording medium in the print zone.

BACKGROUND OF THE INVENTION

In a conventional carriage-style printer, the paper (or other recording medium) is successively advanced such that a portion of the paper is located within a print zone. While the paper is held stationary, a printhead is moved along a carriage scan direction that is substantially perpendicular to the paper advance direction, and marks are made by the printhead on the paper in the print zone as the printhead moves past.

An example of such a carriage style printer is an inkjet printer, where the printhead includes an array of nozzles arranged in an array direction that is substantially parallel to the paper advance direction. The print zone within which printing may be done corresponds to the region between the two endmost nozzles in the array. The printhead and at least a portion of the ink supply for the printhead are typically located on a carriage which moves back and forth along a carriage guide rail. For good image quality, it is important to position the nozzles within a predetermined range of acceptable distances from the paper in the print zone. If the nozzles and the corresponding printhead face are positioned too close to the media support that holds the recording medium, the printhead can undesirably strike a sheet of recording medium in the print zone, particularly if the recording medium is thicker than anticipated, or if the recording medium is cockled, dog-eared, or otherwise not held flatly against the media support. On the other hand, if the nozzles and the corresponding printhead face are positioned too far from the media support, jets that are misdirected land further out of position on the recording medium than they would if the nozzles were closer to the recording medium. The resulting misaligned spots result in objectionable image artifacts.

In many carriage-style printers, the carriage guide rail is a round rod, and the carriage includes a corresponding rounded recess or bushing which slides along the round rod. The carriage guide rail bears the weight of the carriage and is primarily responsible for the accurate travel of the carriage. A second rail, i.e., the anti-rotation rail is used to make contact with an extension of the carriage in order to fix the carriage rotational orientation about the carriage guide rail axis. The anti-rotation rail can be a second round rod, but it can typically be made more cost effectively out of sheet metal as shown in, for example, U.S. Pat. No. 5,368,403.

One method used in the prior art to adjust the spacing between the printhead nozzle face and the paper is to adjust the interface between the extension of the carriage and the anti-rotation rail, such that the carriage is allowed to rotate forward about the carriage guide rail to position the printhead nozzle face closer to the media support, or is caused to rotate backward about the carriage guide rail to position the printhead nozzle face farther from the media support. Typically such carriage rotation positions are not locked into place. In some cases this allows for the user changing the spacing between the printhead and the recording medium during a printing job or between printing jobs. However, the adjustment mechanisms to enable such spacing changes can be complex.

What is needed is a simple adjustment mechanism and method for setting a spacing between the printhead and the media support after the printer has been assembled in the factory, and locking the setting in place.

SUMMARY OF THE INVENTION

A method is provided for setting a distance between a printhead and a media support within a preselected acceptable range. The printing method includes moving the printhead, supporting the carriage using a guide rail, and limiting an amount of rotation of the carriage around the guide rail using an anti-rotation rail. A lockable adjustment mechanism sets the printhead distance using a rotatable variable spacer that can be locked into place. The spacer can include several faces at selected distances from a center of the spacer. These faces can be brought into contact with an anti-rotation rail for securing the rotatable spacer in place. A distance between the printhead and the media support is different when a second face is in contact with the anti-rotation rail as compared to when the first face is in contact with the anti-rotation rail. Notches contained in the spacer mate with a locking tab for locking the spacer in position.

The method also provides for setting a spacing between a portion of a printhead and a portion of a media support in a printing system. The method includes assembling the printing system such that a face of rotatable variable spacer is in contact with an anti-rotation rail that spaces the printhead from the media support. A locking tab is engaged to lock the printhead in place. Another step of the method includes measuring the spacing between the printhead and the media support. If the measured spacing is acceptable then the method for setting the spacing is complete. If the measured spacing is not acceptable, then another face of the rotatable variable spacer is brought into contact with the anti-rotation rail.

A method is also provided for fixing a distance between a printhead and a media support in a printer. The method includes steps for attaching the printhead to a carriage, attaching an elongated guide rail to the printer, and attaching the carriage to the elongated guide rail such that the carriage is capable of freely rotating at least partially around the guide rail. The carriage is supported by the guide rail moves along the guide rail during printing along the carriage scan axis.

A lockable rotatable spacer is coupled to the carriage. The spacer has a central axis about which it can be rotated to bring any one of a plurality of contact points to bear against an anti-rotation rail. The rail is also attached to the printer. The contact points are disposed at a different distance from the central axis so that as the spacer is rotated a selected one of the contact points can be made to abut the anti-rotation rail, which sets the distance between the central axis and the anti-rotation rail. This, in turn, sets an angle of the carriage around the guide rail and sets the distance between the printhead and the media support. The lockable rotatable spacer can be locked into position to prevent its rotation.

A locking tab is formed on the carriage for engaging one of a number of catches in the spacer. When engaged, these components prevent the spacer from rotating, thereby locking the spacer into place. The catches are spaced apart and correspond to a contact point on the spacer that abuts the anti-rotation rail. A selected catch engages the locking tab by rotating the spacer into a selected position. The contact point on the spacer can be shaped into a planar face on the spacer. One way to set the distance between the printhead and the media support is to measure the distance and, if the distance is not within a preferred range, selecting which one of the plurality of contact points will abut the anti-rotation rail and then rotating the spacer into that position and locking it there. The spacer can be rotated in a clockwise or counter-clockwise direction to select and appropriately distanced contact point for abutting the anti-rotation rail. This can include moving the spacer so that its catch disengages the locking tab, thereby allowing it to rotate to an acceptable position and reengaging another catch with the locking tab. A spring loaded screw can be used to bias the catch into engagement with the locking tab, which screw can be loosened to disengage a catch from the locking tab. The screw can be tightened to further fix the engagement of the catch and locking tab. A stopper can be employed so that the rotatable spacer can be rotated until further rotation is prevented by the stopper. That stopped position can be designed to coincide with a position of the spacer where one of its catches engages the locking tab.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. Many changes and modifications may be made within the scope of the present invention without departing from the spirit thereof, and the invention includes all such modifications. The figures below are not intended to be drawn to any precise scale with respect to relative size, angular relationship, or relative position.

DETAILED DESCRIPTION OF THE INVENTION

Figure 1:
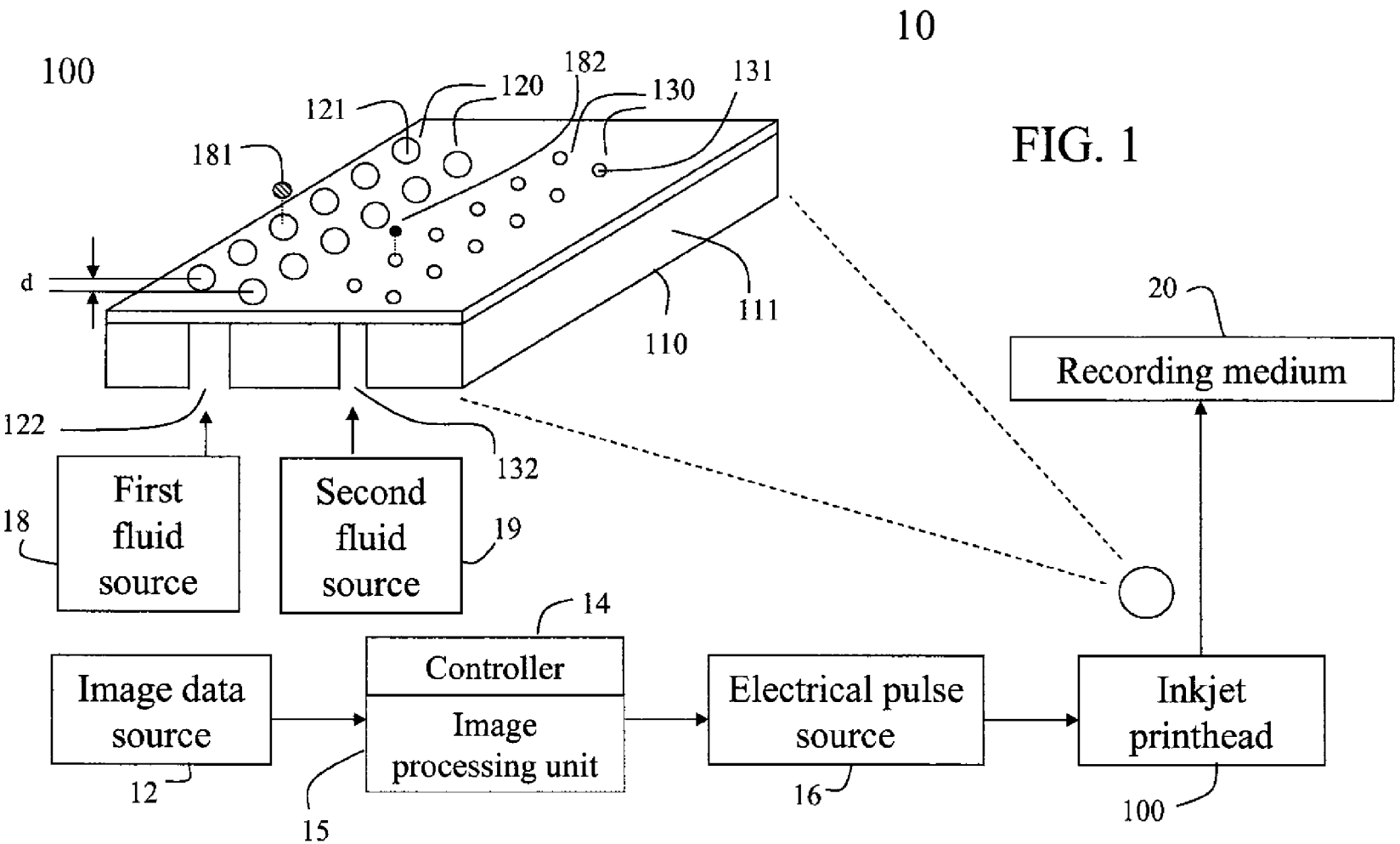
FIG. 1 is a schematic representation of an inkjet printer system.

Referring to FIG. 1, a schematic representation of an inkjet printer system 10 is shown for its usefulness with the present invention and is fully described in U.S. Pat. No. 7,350,902, which is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays in the printhead. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e., $d=1/1200$ inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. Other arrangements and designs of nozzles and ink delivery channels may be used together with the present invention and are not considered critical to the scope of the present invention, as will be explained more fully below. More than one inkjet printhead die 110 can be included in inkjet printhead 100, but for greater clarity only one inkjet printhead die 110 is shown in FIG. 1. The printhead dies are arranged on a support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on inkjet printhead die 110. In some embodiments, all nozzles on inkjet printhead die 110 can be the same size, rather than having multiple-sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
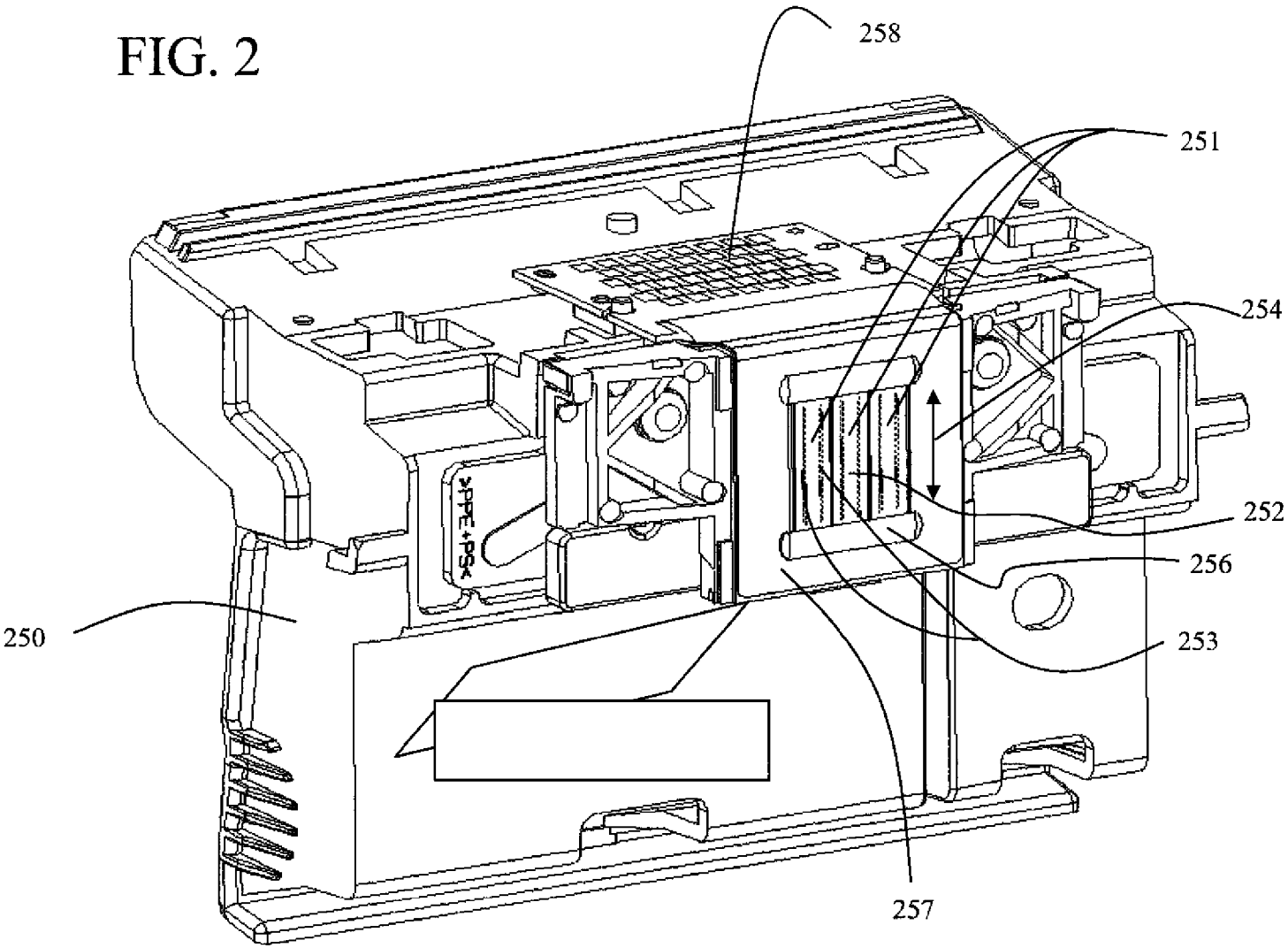
FIG. 2 is a perspective view of a portion of a printhead chassis.

FIG. 2 shows a perspective view of a portion of a printhead chassis 250, which is an example of a chassis for implementing an inkjet printhead 100. Printhead chassis 250 includes three printhead die 251 (similar to inkjet printhead die 110 in FIG. 1), each printhead die 251, containing two nozzle arrays 253, so that printhead chassis 250, contains six nozzle arrays 253 altogether. The face of any printhead die 251, containing nozzle arrays 253 (or collectively all such faces on individual printhead die 251) is referred to herein as the printhead nozzle face 252. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 inches by 11 inches). Thus, in order to print a full image, a number of swaths are successively printed while moving printhead chassis 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or tape-automated bonding (TAB). The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals can be transmitted to the printhead die 251.

Figure 3:
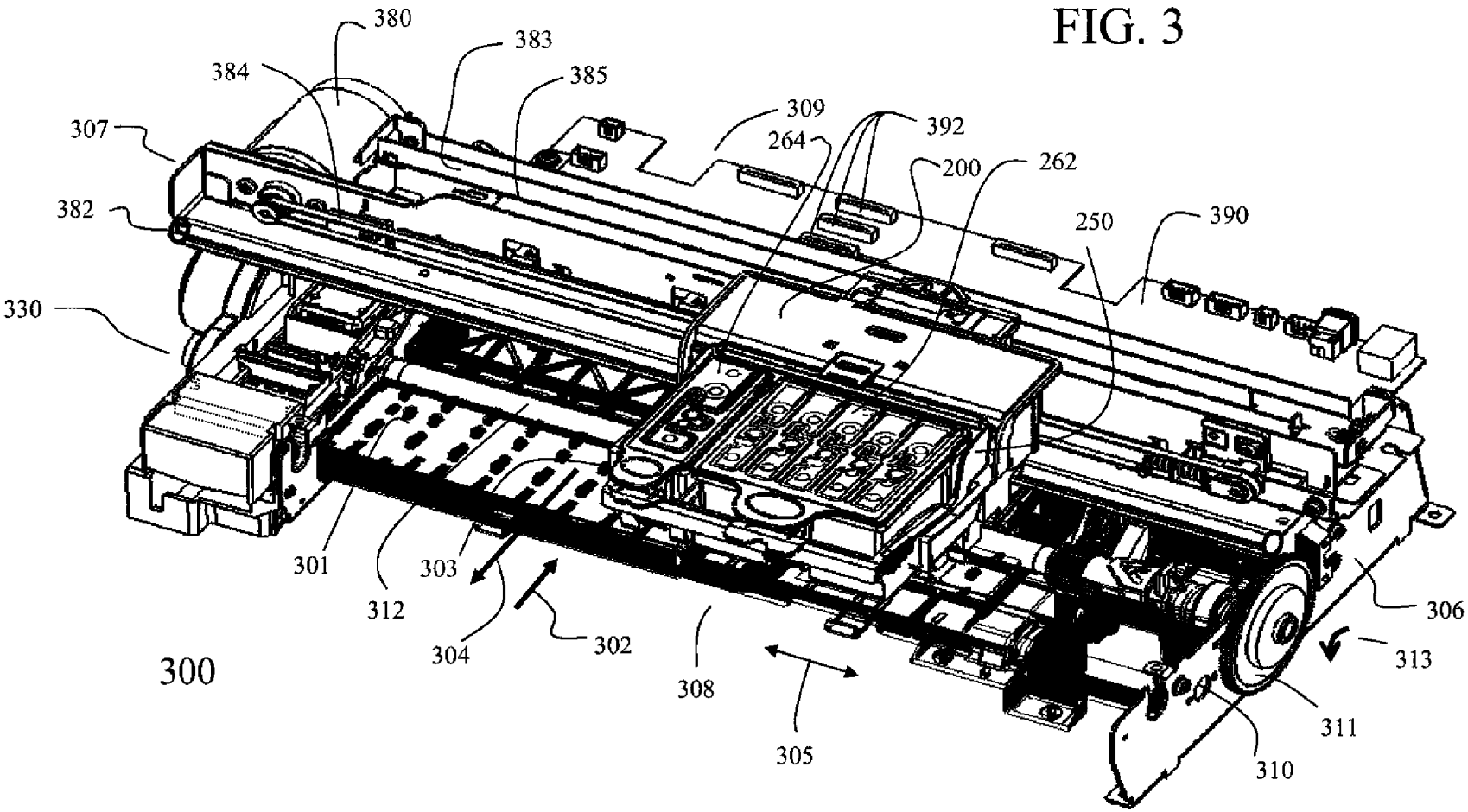
FIG. 3 is a perspective view of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth along carriage scan direction 305, between the right side 306 and the left side 307 of printer chassis 300, while drops are ejected from printhead die 251 (not shown in FIG. 3) on printhead chassis 250 that is mounted on carriage 200. A media support 301 helps to hold the recording medium flat in print zone 303. Carriage motor 380 moves belt 384 to move carriage 200 along carriage guide rail 382. An encoder sensor (not shown) is mounted on carriage 200 and indicates carriage location relative to an encoder fence 385.

Printhead chassis 250 is mounted in carriage 200, and multi-chamber ink supply 262 and single-chamber ink supply 264 are mounted in the printhead chassis 250. The mounting orientation of printhead chassis 250, as shown in FIG. 3, is rotated relative to the view in FIG. 2, so that the printhead die 251 are located at the bottom side of printhead chassis 250, the droplets of ink being ejected downward onto the recording medium in print region 303 (i.e., the print zone) in the view of FIG. 3. Multi-chamber ink supply 262, in this example, contains five ink sources: cyan, magenta, yellow, photo black, and colorless protective fluid; while single-chamber ink supply 264 contains the ink source for text black. Paper or other recording medium (sometimes generically referred to as paper or media herein) is loaded along paper load entry direction 302 toward the front of printer chassis 308.

Figure 4:
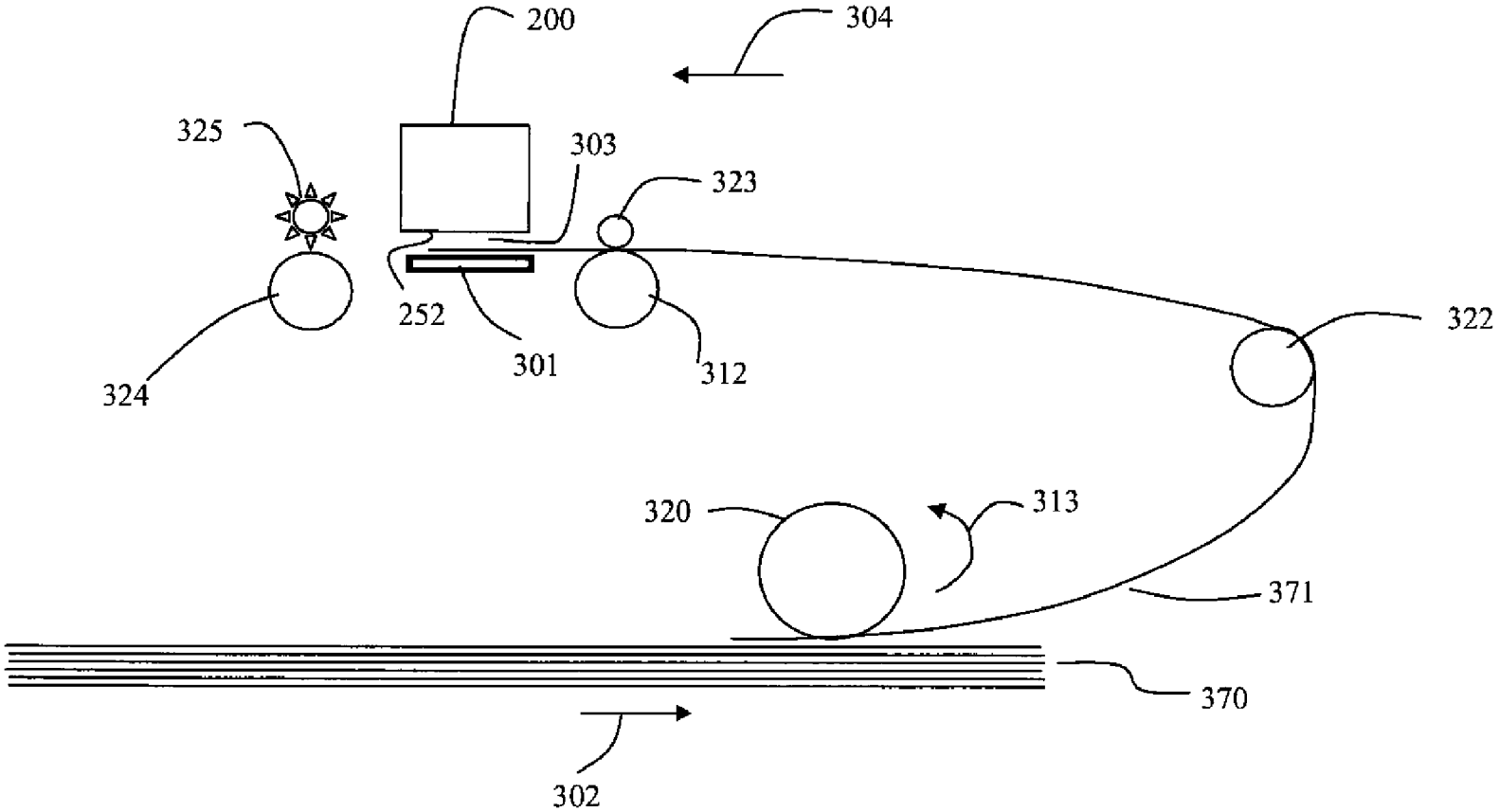
FIG. 4 is a schematic side view of an exemplary paper path in a carriage printer.

A variety of rollers are used to advance the medium through the printer as shown schematically in the side view of FIG. 4. In this example, a pick-up roller 320 moves the top piece or sheet 371 of a stack 370 of paper or other recording medium in the direction of the arrow showing paper load entry direction 302. A turn roller 322 acts to move the paper around a C-shaped path (in cooperation with a curved rear wall surface of the printer, not shown) so that the paper continues to advance along media advance direction 304 from the rear of the printer chassis 309 (with reference also to FIG. 3). The paper is then moved by feed roller 312 and idler roller(s) 323 to advance across print region 303 and from there to a discharge roller 324 and star wheel(s) 325 so that printed paper exits along media advance direction 304. When the paper is held by both feed roller 312 and star wheels 325, media support 301 helps to keep the paper flat in the print region 303. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330.

Toward the rear of the printer chassis 309, in this example, is located the printer electronics board 390, which includes cable connectors 392 for communicating via cables (not shown) to the printhead carriage 200 and from there to the printhead chassis 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 5:
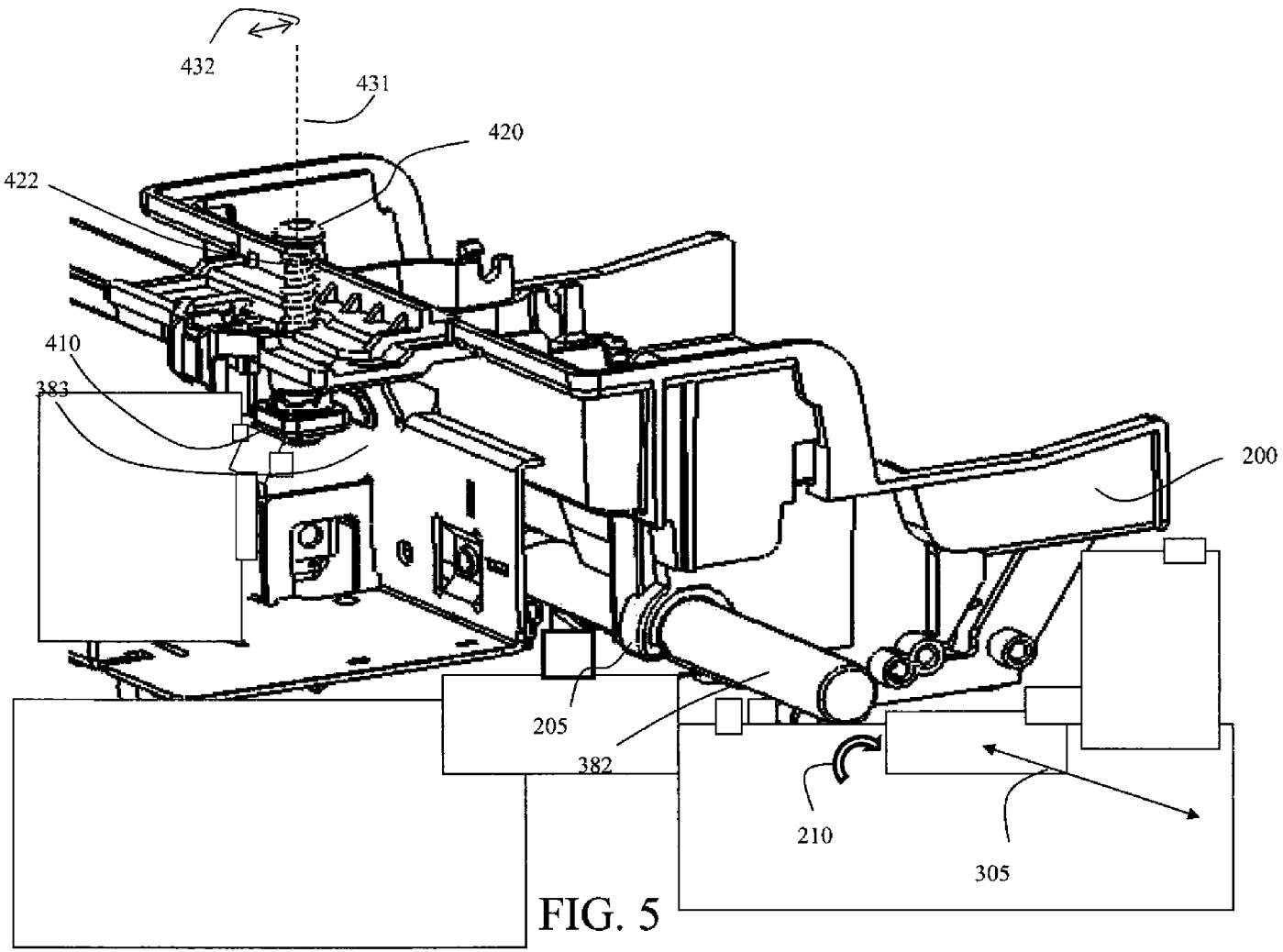
FIG. 5 is a perspective view of a portion of a printing system according to an embodiment of the present invention.
Figure 6:
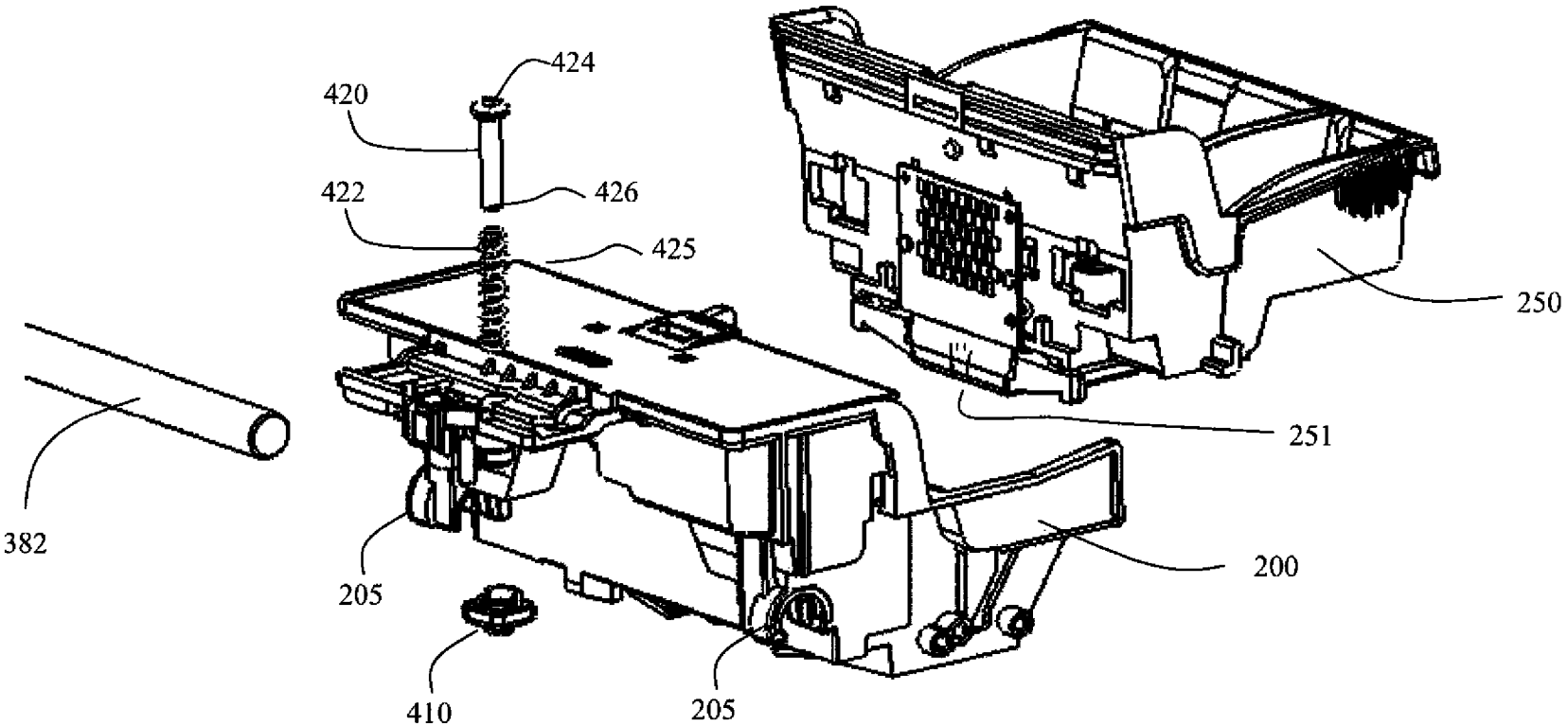
FIG. 6 is an exploded view of a portion of a printing system according to an embodiment of the present invention.

FIG. 5 is a perspective view and FIG. 6 is an exploded view of a portion of a printing system according to one preferred embodiment of the present invention. Carriage 200 is movable along carriage guide rail 382 disposed along carriage scan axis 305. Carriage guide rail 382 is typically a round rod, but is not limited to such a geometry. One or more carriage bushings 205 can provide a mechanical contact surface between the carriage 200 and the carriage guide rail 382. Particularly when the printhead chassis 250 is loaded into the carriage 200, the center of mass of the carriage 200 is forward of the carriage guide rail 382, so that the carriage 200 tends to rotate about the carriage guide rail 382 in the carriage rotation direction 210. A rotatable spacer 410 is provided to contact anti-rotation rail 383 in order to limit the amount of rotation of the carriage 200 in carriage rotation direction 210. Rotatable spacer 410 has an axis of rotation 431. In the embodiment shown in FIG. 5, axis of rotation 431 is substantially perpendicular to carriage scan axis direction 305. Rotatable spacer 410 has a plurality of contact faces or contact points (described below in more detail) that are at different spacings from the axis of rotation 431. Depending upon which contact face is selected to be contact with anti-rotation rail 383, the center of rotatable spacer 410 moves closer to, or further from, the anti-rotation rail 383 along direction 432. To move the center of rotatable spacer 410 closer to the anti-rotation rail 383, the carriage 200 must rotate along carriage rotation direction 210. To move the center of rotatable spacer 410 further from the anti-rotation rail 383, the carriage 200 must rotate in the opposite direction from carriage rotation direction 210. Rotatable member 420 is coupled to rotatable spacer 410. In one preferred embodiment, rotatable member 420 is a screw and rotatable spacer 410 has a threaded hole to accept the screw end 426 that is opposite the head 424 of the screw. A compression spring 422 can be provided to surround screw 426 and to bias screw head 424 in a bias direction 425 pointing away from rotatable spacer 410 along the axis of rotation 431.

Figure 7:
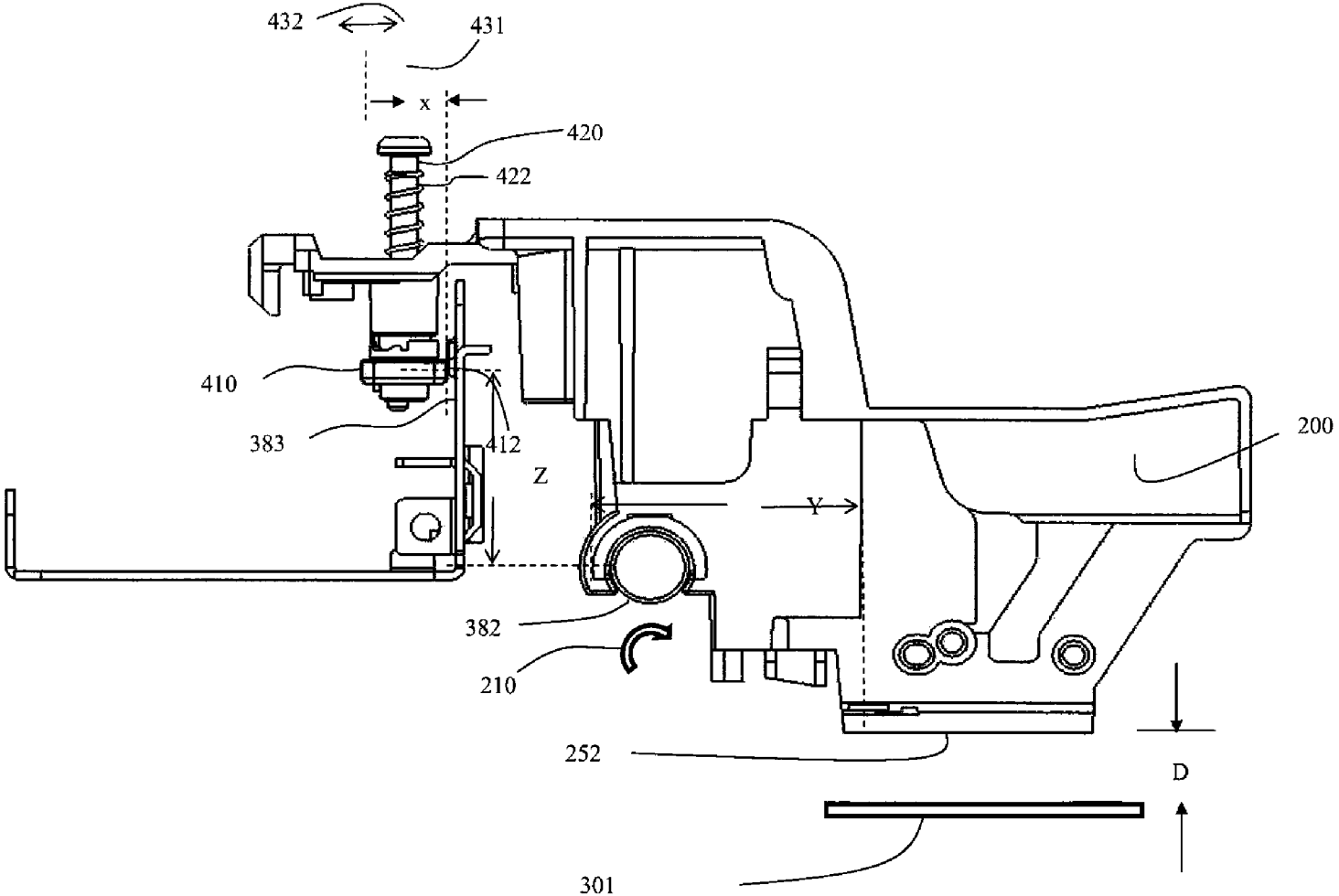
FIG. 7 is an end view of a portion of a printing system according to an embodiment of the present invention.

FIG. 7 is an end view of the embodiment shown in FIGS. 5 and 6. A first contact face 412 of rotatable spacer 410 is in contact with anti-rotation rail 383. The distance that first contact face 412 is from the axis of rotation 431 determines how much carriage 200 can rotate in carriage rotation direction 210 around carriage guide rail 382. Printhead nozzle face 252 is located near the bottom of carriage 200. A distance D between printhead nozzle face 252 and media support 301 is determined by the amount of rotation of carriage 200 around carriage guide rail 382. Let x be the distance between the center of rotatable spacer 410 and anti-rotation rail 383. If the center of rotatable spacer 410 moves in the direction 432 with respect to anti-rotation rail 383 by a distance $\Delta x$, the change in distance D between media support 301 and a point on the printhead nozzle face 252 that is located a distance Y from the center of carriage guide rail 382 is $\Delta D \sim Y\Delta x/Z$, where Z is the distance of the point of contact above the center of the carriage guide rail 382.

Figure 8:
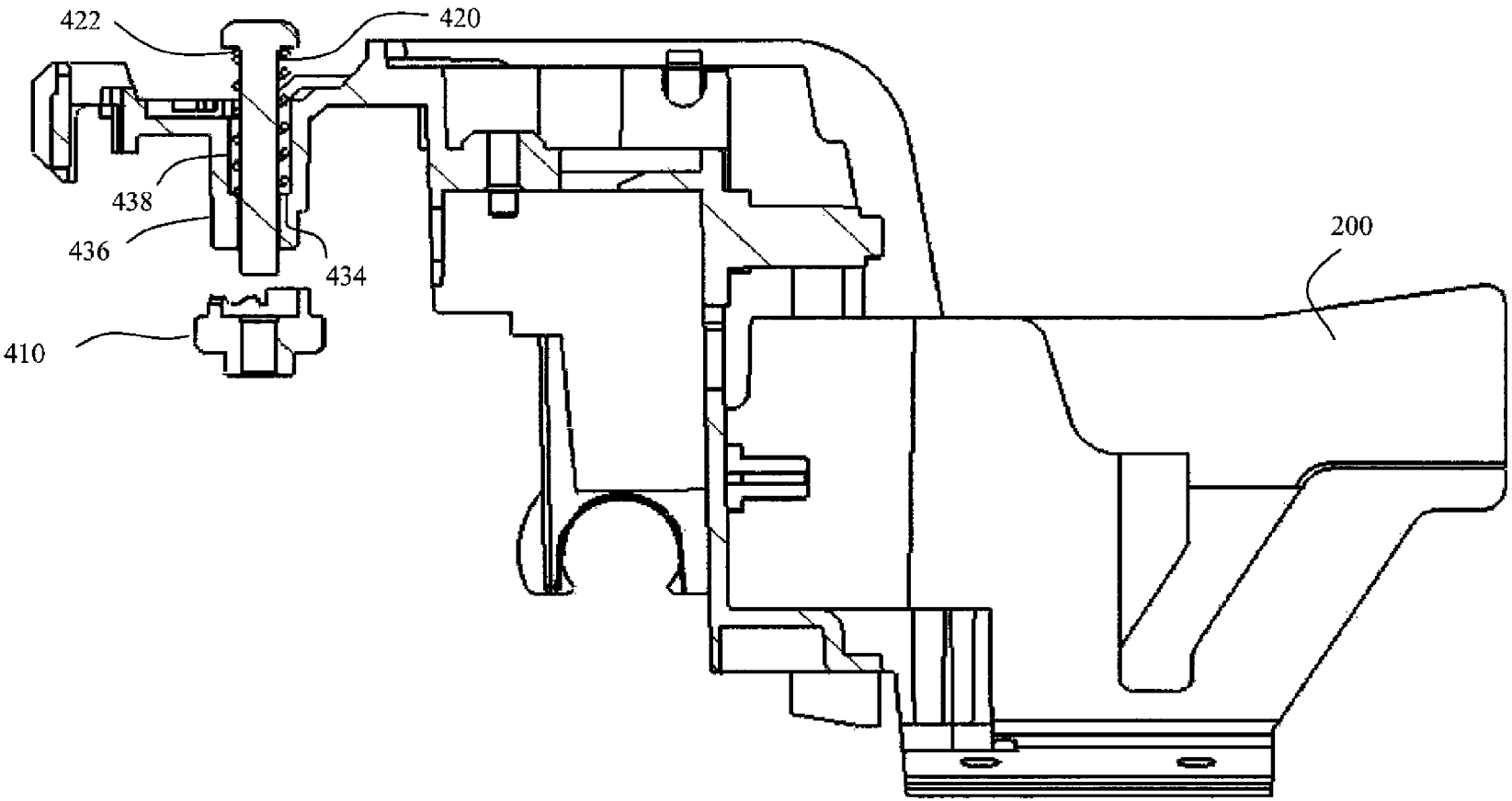
FIG. 8 is a cross-sectional view of the embodiment shown in FIGS. 5 through 7.
Figure 9:
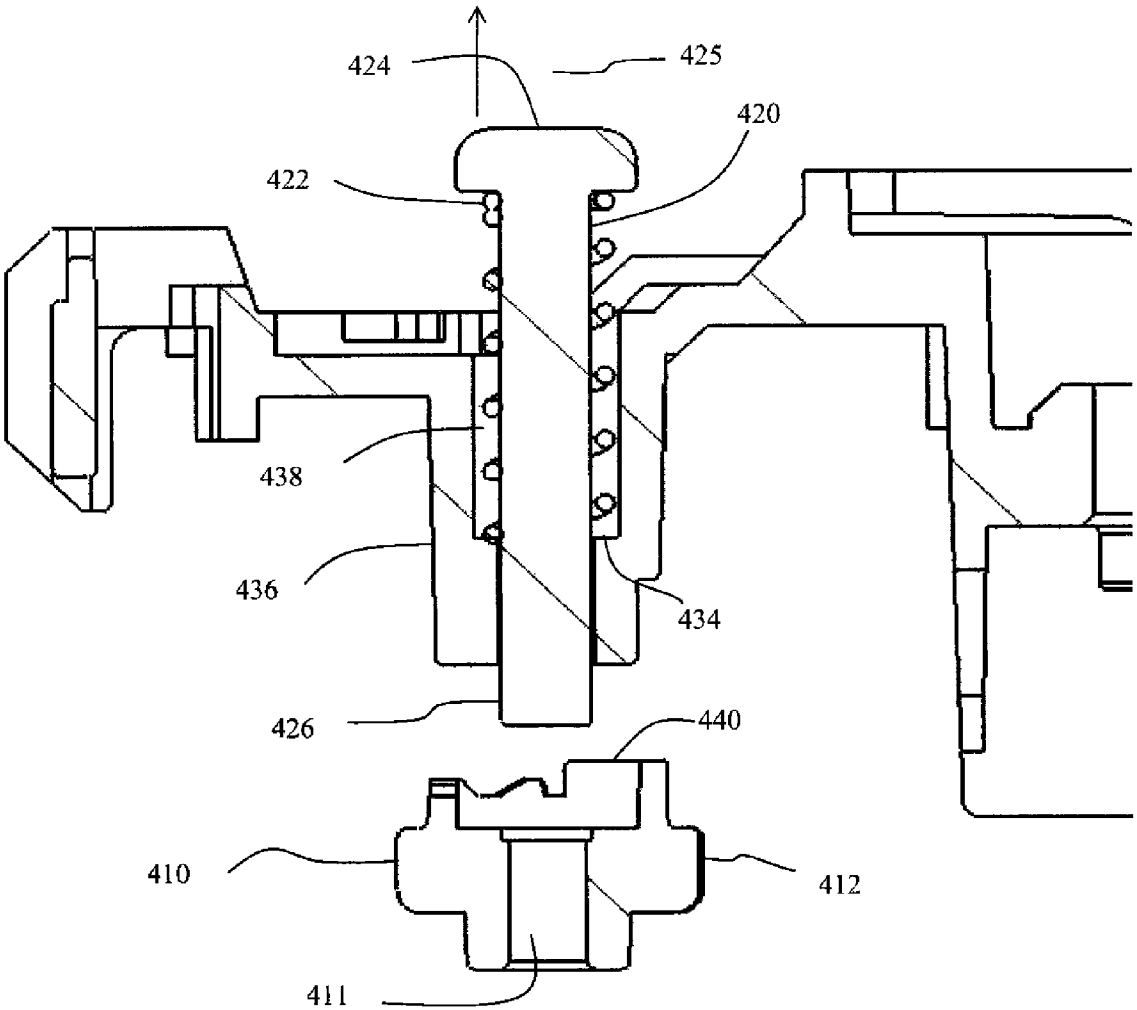
FIG. 9 is a close-up of the view shown in FIG. 8.

FIG. 8 is a cross-sectional view of the embodiment of FIGS. 5 through 7 showing rotatable spacer 410 separately from spring-biased screw 420, and FIG. 9 is a close-up view of FIG. 8. Compression spring 422 is held against a ledge 434 around the inside of hole 438 in an extension 436 of carriage 200. End 426 of screw 420 also can be passed through hole 438 to screw into threaded hole 411 of rotatable spacer 410. Compression spring 422 is compressed between ledge 434 and screw head 424 to provide a biasing force on screw head 424 in bias direction 425. Rotatable spacer 410 includes a plurality of contact faces, including first contact face 412. Rotatable spacer 410 also includes a rim 440 that has a plurality of notches to be described below. Although the figures show discrete planar contact faces, the rotatable spacer could be designed with a continuous eccentric surface or with other structures, such as a series of contact bumps, for providing a variable distance between the central axis of the rotatable spacer and the anti-rotation rail 383.

Figure 10:
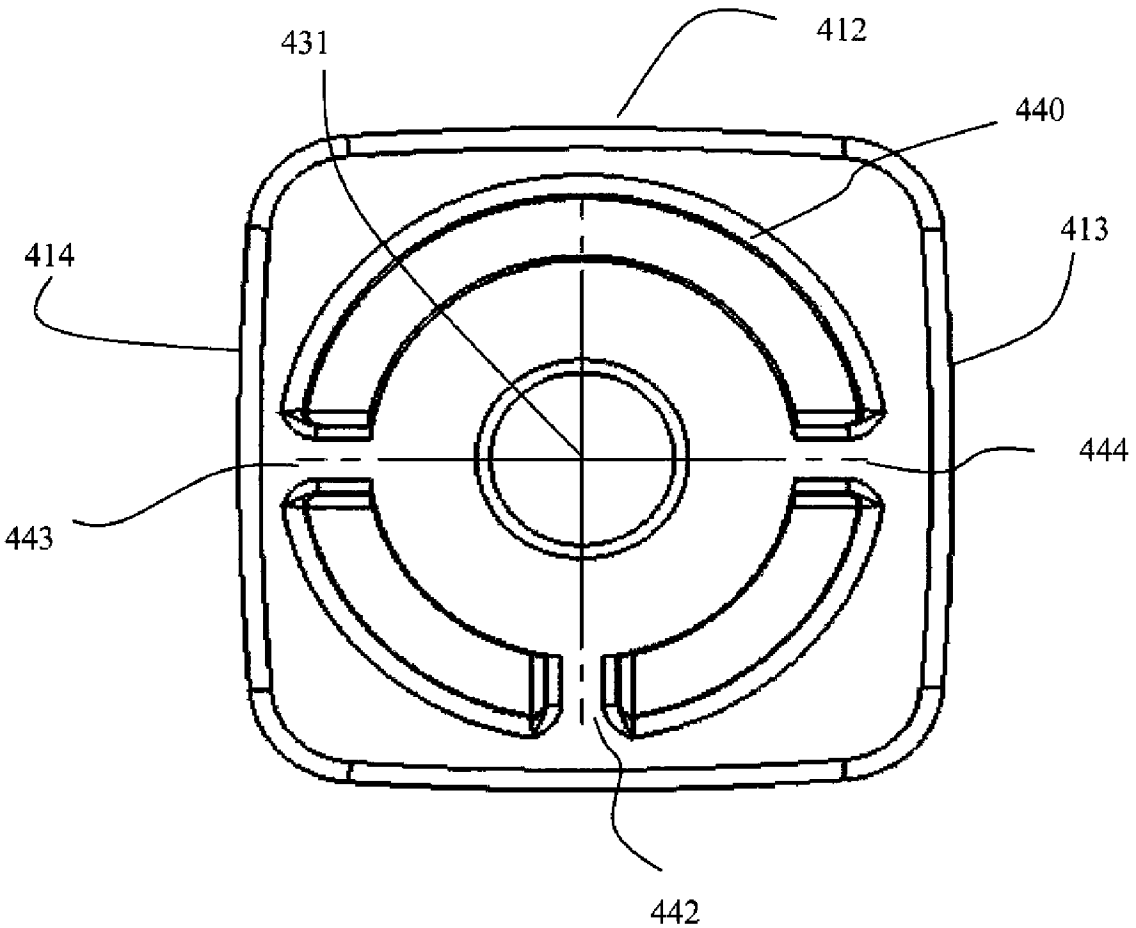
FIG. 10 shows a top view of a rotatable spacer according to an embodiment of the present invention.
Figure 11:
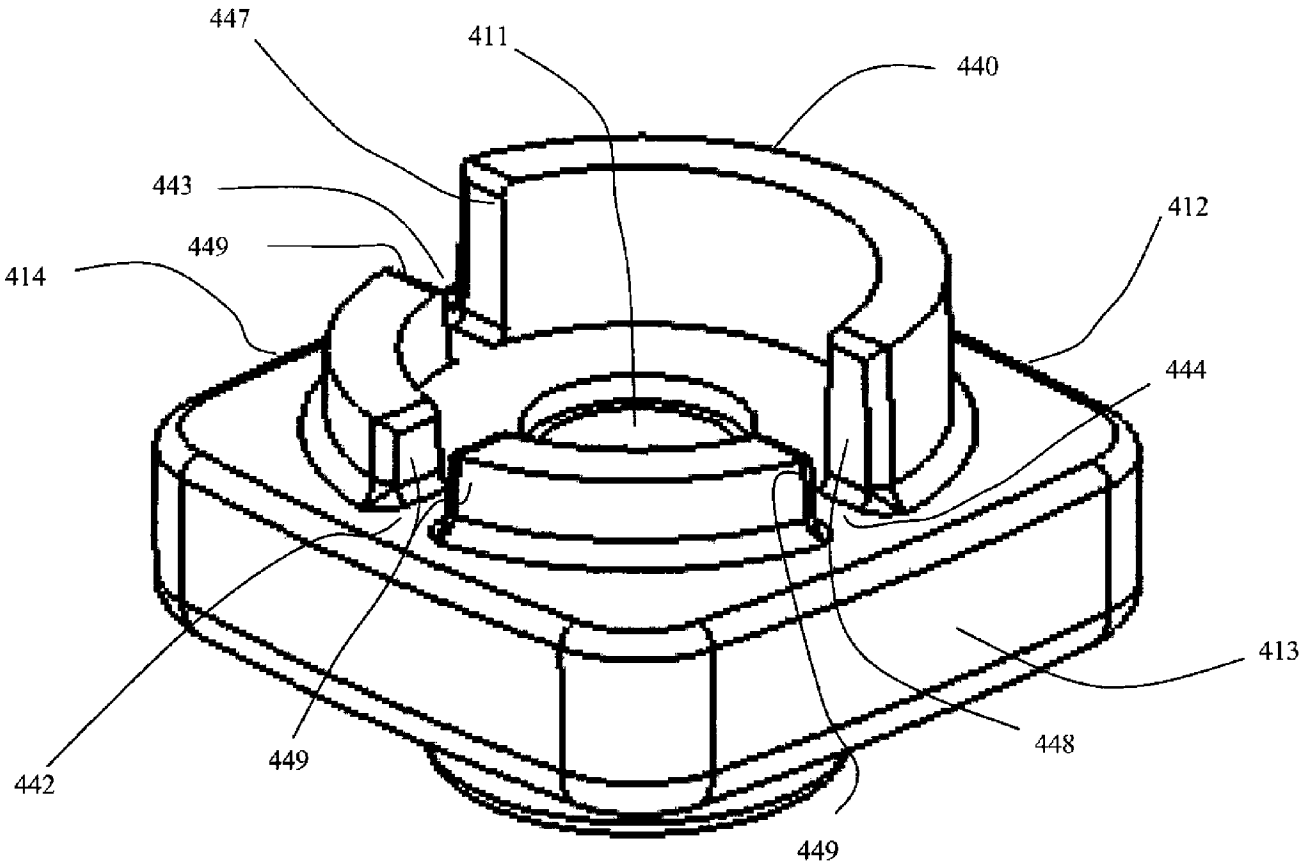
FIG. 11 shows a top perspective view of a rotatable spacer according to an embodiment of the present invention.

FIG. 10 shows a top view and FIG. 11 shows a top perspective view of rotatable spacer 410. In the embodiment shown in FIGS. 10 and 11, rotatable spacer 410 includes first contact face 412, second contact face 413 and third contact face 414. The distance of the first contact face to the axis of rotation 431 of rotatable spacer 410 is a first distance, such as 5.0 mm. The distance of the second contact face to the axis of rotation 431 is a second distance, such as 5.18 mm, which is greater than the first distance. The distance of the third contact face to the axis of rotation 431 is a third distance, such as 4.82 mm, which is less than the first distance. First contact face 412 corresponds to a nominal spacing adjustment for the spacing D between the printhead nozzle face 252 and the media support 301 (with reference to FIG. 7). Second contact face 413 moves the center of rotatable spacer 410 further away from anti-rotation rail 383 if it is in contact, so that the spacing D between printhead nozzle face 252 and media support 301 will be greater than if the first contact face were in contact with the anti-rotation rail 383. Similarly, third contact face 414 allows the center of rotatable spacer 410 to move closer to anti-rotation rail 383 if it is in contact, so that the spacing D between printhead nozzle face 252 and media support 301 will be less than if the first contact face were in contact with the anti-rotation rail 383. Again with reference to FIG. 7, if Y/Z=1.2, for example, the change in D when rotating rotatable spacer 410 from a nominal position where the first contact face 412 is in contact with anti-rotation rail 383, for the exemplary dimensions of rotatable spacer 410 given above, is $\Delta D \sim 0.2$ mm if the second contact faced 413 is rotated into contact position, or $\Delta D \sim -0.2$ mm if the third contact face 414 is rotated into contact position.

Directly opposite each contact face is a corresponding notch in rim 440 of rotatable spacer 410. The notches serve as catches in a locking mechanism to hold a selected contact face against anti-rotation rail 383 (with reference to FIG. 7) as will be described below. First notch 442 corresponds to first contact face 412. Second notch 443 corresponds to second contact face 413. Third notch 444 corresponds to third contact face 414. Second notch 443 is 90 degrees of angular rotation away from first notch 442, and third notch 444 is also 90 degrees away from first notch 442, but second notch 443 is 180 degrees away from third notch 444. Similarly, second contact face 413 is 90 degrees of angular rotation away from first contact face 412, and third contact face 414 is also 90 degrees away from first contact face 412, but second contact face 413 is 180 degrees away from third contact face 414. In this configuration it is straightforward to increase the nominal spacing adjustment between the printhead nozzle face 252 and media support 301 by rotating rotatable spacer 410 in one direction by 90 degrees to place the second contact face 413 into contact with anti-rotation rail 383, or to decrease the nominal spacing adjustment between the printhead nozzle face 252 and media support 301 by rotating rotatable spacer 410 in the opposite direction by 90 degrees to place the third contact face 414 into contact with anti-rotation rail 383.

FIG. 11 shows that rim 440 of rotatable spacer 410 has a first height near first contact face 412, but has a lower height near second contact face 413 and third contact face 414. As a result, second notch 443 and third notch 444 each have one tall wall and one short wall 449, while first notch 442 has two short walls 449. In this embodiment, the tall wall of second notch 443 serves as a first stopper 447 that prohibits rotation of rotatable spacer 410 beyond the second notch 443, as will be described below. Similarly, the tall wall of third notch 444 serves as a second stopper 448 that prohibits rotation of rotatable spacer 410 beyond the third notch 444.

FIGS. 12-17 show perspective views of a portion of carriage 200 and a lockable adjustment mechanism 450 for locking a selected contact face into position in order to adjust a distance D between the printhead nozzle face 252 and media support 301 (with reference to FIG. 7) according to an embodiment of the present invention. Lockable adjustment mechanism 450 engages with a locking tab 435, and includes rotatable spacer 410, a first contact face 412, a second contact face 413, a first catch (first notch 442), a second catch (second notch 443 with reference to FIG. 11), and a third catch (third notch 444). In this embodiment, locking tab 435 is part of carriage 200, and more particularly is located on the outside of extension 436. For clarity, anti-rotation rail 383 is not shown in FIGS. 12-17.

Figure 12:
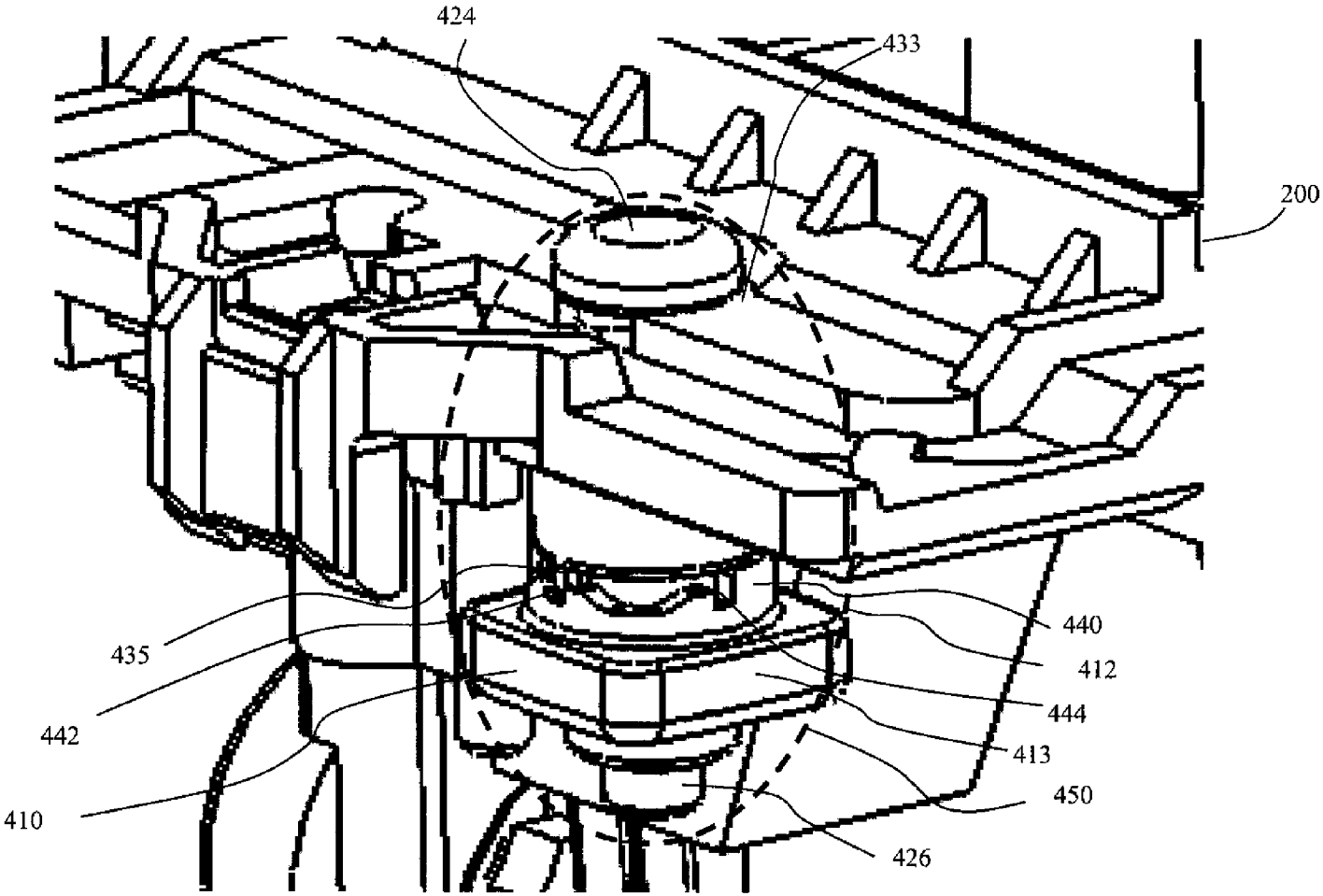
FIG. 12 shows a top perspective view of a first contact face of a rotatable spacer locked into position according to an embodiment of the present invention.

FIG. 12 shows the nominal configuration of the lockable adjustment mechanism 450 with first contact face 412 locked into position to contact anti-rotation rail 383. The nominal configuration is the configuration that the lockable adjustment mechanism 450 is set to when the printers are initially assembled at the factory. In the nominal configuration, locking tab 435 is engaged with the first catch (i.e. locking tab 435 is captured within first notch 442), so that rotatable spacer 410 cannot be rotated. It has been found that spacing D between the printhead nozzle face 252 and the media support 301 (with reference to FIG. 7) is within an acceptable range for many printers when the lockable adjustment mechanism 450 is in its nominal configuration. Further, it has been found that substantially all of the rest of the printers can have spacing D adjusted (e.g. at the factory) into the acceptable range by either rotating the second contact face 413 or the third contact face 414 into position to contact the anti-rotation rail 383. In the locked configuration shown in FIG. 12, screw 420 (with reference to FIG. 7) is tightened so that the bottom surface of screw head 424 is in contact with collar 433, and screw end 426 extends through the bottom of rotatable spacer 410.

After the printer has been assembled, the spacing D between the printhead nozzle face 253 and the media support 301 is measured directly and the appropriate contact face to be in contact with anti-rotation rail 383 is selected. In another embodiment, the spacing D can be determined indirectly prior to installing the printhead on a printhead support formed in the carriage. In this embodiment, a spacing D' is measured as between the printhead support and the media support. This distance D' indicates what the spacing D would be when the printhead is attached to the printhead support with prior knowledge of the mounting configuration of the printhead. If spacing D is within an acceptable range, then first contact face 412 is kept in contact with anti-rotation rail 383. If spacing D is not within an acceptable range, the lockable adjustment mechanism 450 is subsequently unlocked. The rotatable spacer 410 is then rotated in a first rotational direction such that second contact face 413 is moved into position to contact anti-rotation rail 383 if the measured spacing is less than the acceptable range, or the rotatable spacer 410 is rotated in a rotational direction that is opposite the first rotational direction, such that third contact face 414 is moved into position to contact anti-rotation rail 383 if the measured spacing is greater than the acceptable range.

Figure 13:
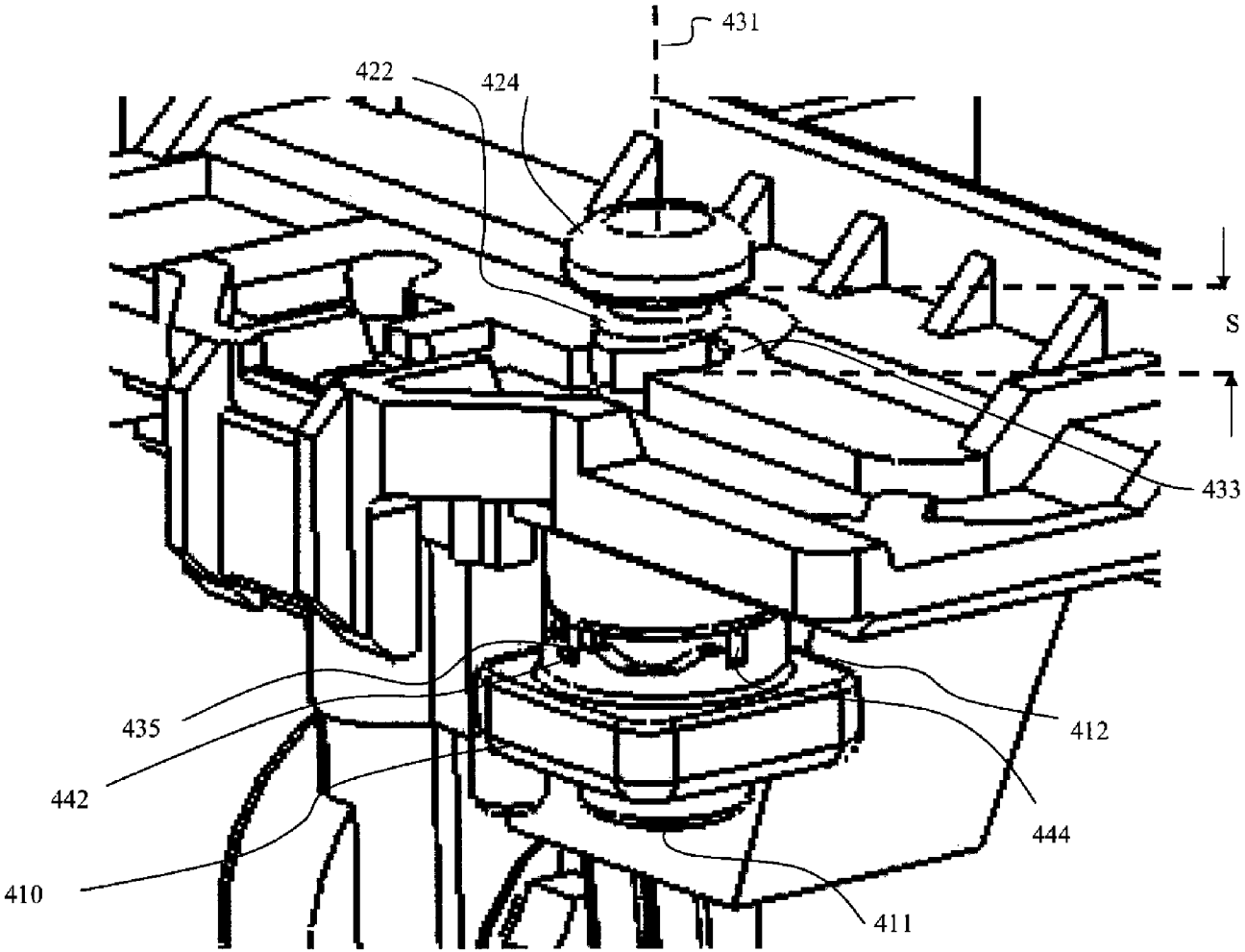
FIG. 13 shows the embodiment of FIG. 12 after a spring-loaded screw has been loosened.

FIG. 13 shows a first operation for unlocking the lockable adjustment mechanism 450. Rotatable member (screw) 420 (with reference to FIG. 9) is loosened so that compression spring 422 pushes screw head 424 up so that the bottom surface of screw head 424 is a spacing S from collar 433. This extra spacing S is provided by withdrawing screw end 426 (with reference to FIG. 12) upward into threaded hole 411 of rotatable spacer 410 by partially unscrewing screw 420. At this stage, locking tab 435 is still engaged with first notch 442, and first contact face 412 is still in position to contact anti-rotation rail 383. Rotatable member (screw) 420 includes threads proximate to screw end 426 which engage threads interior to hole 411 sufficient to operate the screw and the rotatable spacer as described herein. The threads are not shown in the figures.

Figure 14:
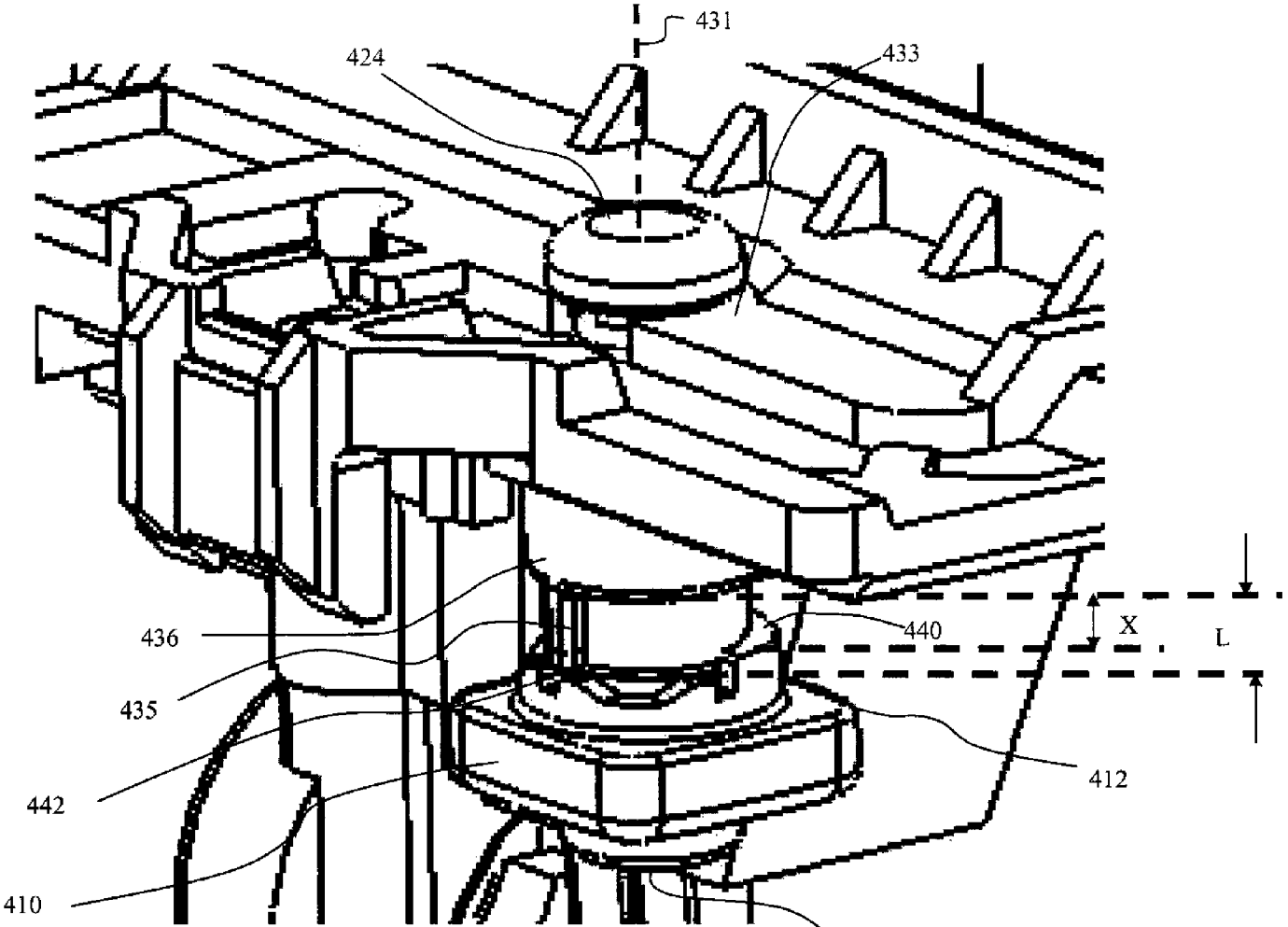
FIG. 14 shows the embodiment of FIG. 13 after the spring-loaded screw has been pushed downward.

FIG. 14 shows a second operation for unlocking the lockable adjustment mechanism 450. Screw head 424 is pushed down along the axis of rotation 431 toward collar 433. With reference to FIG. 13, screw head 424 can be pushed down by a first travel distance X which can be as large as the spacing S provided by loosening screw 420, and typically X=S. Because the threads of screw end 426 are still engaged with threaded hole 411, rotatable spacer 410 is thereby pushed downward by the first travel distance X along the axis of rotation 431, moving first notch 442 away from locking tab 435. Comparing FIG. 14 with FIG. 13 it can also be seen that pushing screw head 424 down has opened up a gap between the bottom of extension 436 and the top of rim 440. First travel distance X is sufficient so that short walls 449 (with reference to FIG. 11) are below locking tab 435, so that locking tab 435 is released from the first catch (i.e. from first notch 442) and rotatable spacer 410 can be freely rotated either to second catch (notch 443) or third catch (notch 444). In other words, when the rotatable spacer 410 is located at the first travel distance X along the axis of rotation 431, there are no stoppers in a region that is located between the first stopper 447 and the second stopper 448. However, first travel distance X does not provide clearance of locking tab 435 relative to stoppers 447 and 448. As a result, if rotatable spacer 410 is rotated toward second notch 443, its rotation is limited by an interference of locking tab 435 with first stopper 447, so that tactile feedback is provided to the adjuster to indicate that locking tab 435 is aligned with second notch 443. Similarly, if rotatable spacer 410 is rotated in the opposite direction toward third notch 444, its rotation is limited by an interference of locking tab 435 with second stopper 448, so that tactile feedback is provided to the adjuster to indicate that locking tab 435 is aligned with third notch 444. In FIG. 14, however, rotation of rotatable spacer 410 has not yet occurred, so that first contact face 412 is still in position to contact anti-rotation rail 383. FIG. 14 also indicates that locking tab 435 has a lengthwise dimension L that is oriented substantially parallel to the axis of rotation 431. Lengthwise dimension L is typically longer than first travel distance X, so that locking tab 435 will hit stoppers 447 or 448 if rotatable spacer 410 is rotated to place the second contact face 413 or the third contact face 414 respectively in position to contact the anti-rotation rail 383.

Figure 15:
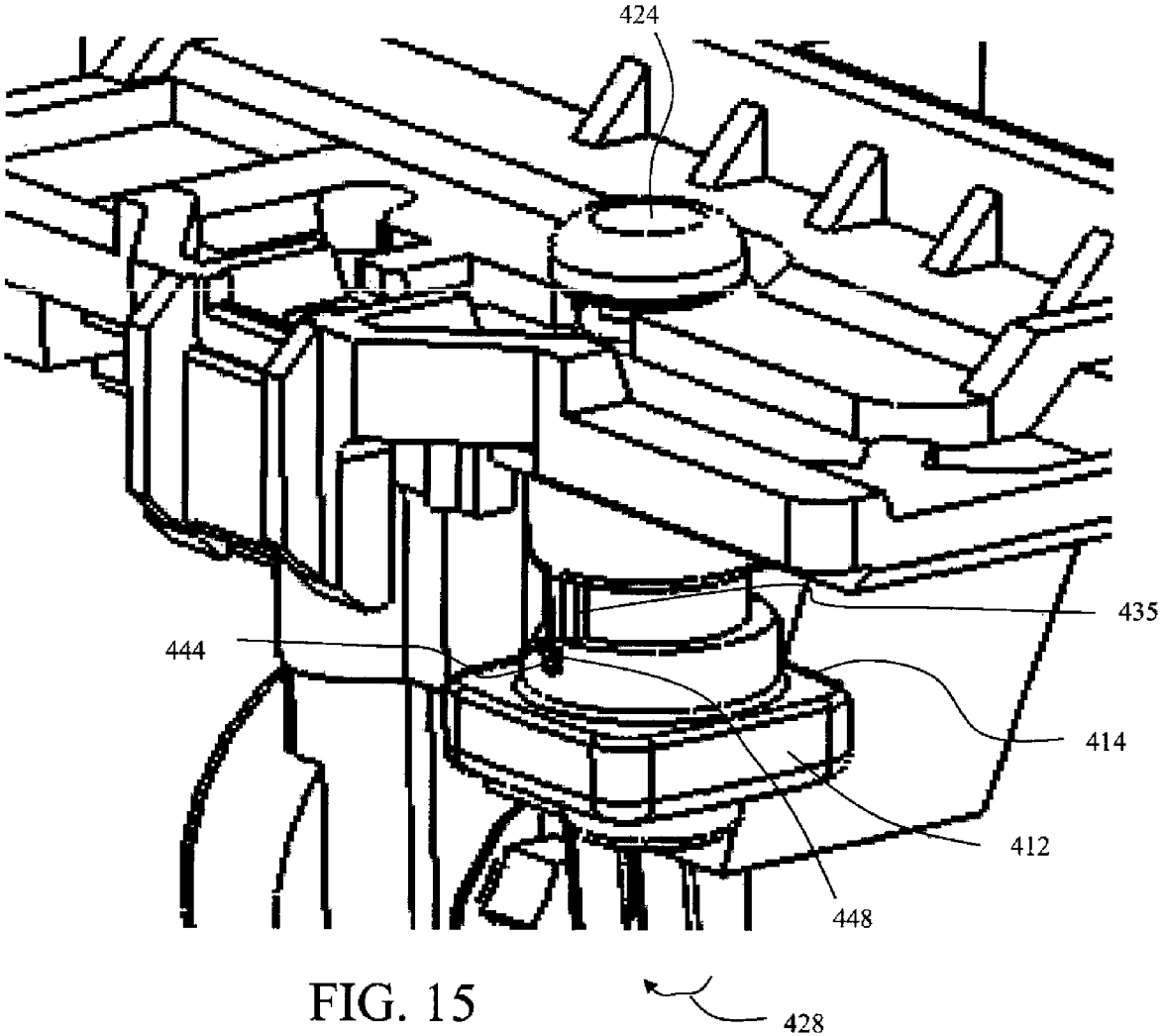
FIG. 15 shows the embodiment of FIG. 14 after the rotatable spacer has been rotated to place a different contact face into position.

With the locking tab 435 released from the first catch (first notch 442) as a result of the operation shown in FIG. 14, rotatable spacer 410 can now be rotated as shown in FIG. 15. While still holding screw head 424 down, friction between the threads of screw end 426 and threaded hole 411 causes rotatable spacer 410 to rotate when the screw head 424 is rotated about the axis of rotation 431. During the rotation of rotatable spacer 410, it is not in contact with anti-rotation rail 383, so it is free to rotate. For example, with reference to FIG. 7, rotatable spacer 410 can be moved out of contact with anti-rotation rail 383, by rocking carriage 200 backward around carriage guide rail 382 in a direction that is opposite to carriage rotation direction 210. In FIG. 15, rotatable spacer 410 has been rotated in direction 428 until locking tab 435 hit second stopper 448, indicating that rotatable spacer is in position for locking tab 435 to engage with a third catch (third notch 444, in this case). As a result, first contact face 412 is no longer in position to contact anti-rotation rail 383. Rather, third contact face 414 is in position to contact anti-rotation rail 383, thereby allowing the spacing D between the printhead nozzle face 252 and media support 301 to decrease.

Figure 16:
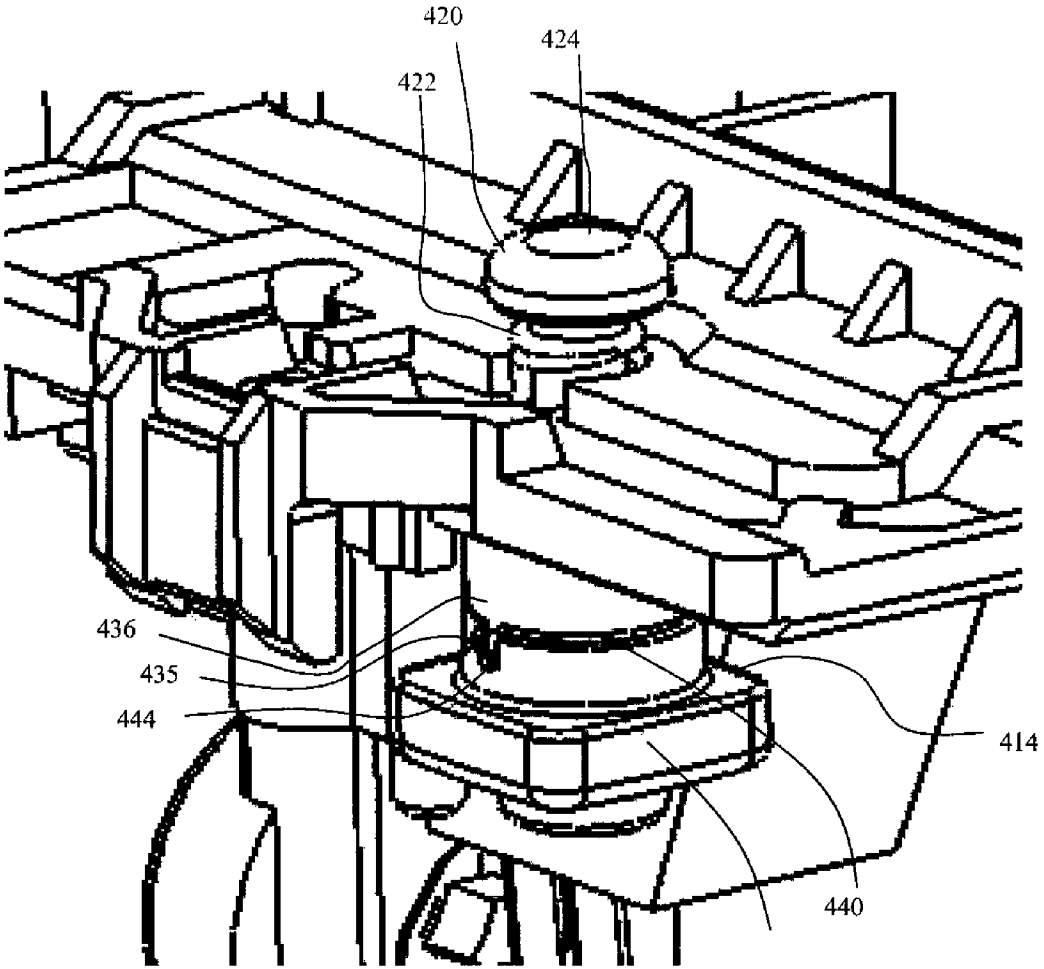
FIG. 16 shows the embodiment of FIG. 15 after the hold-down force on the spring-loaded screw has been released.

FIG. 16 shows the result of releasing the hold-down force on screw head 424. Compression spring 422 pushes screw head 424 up, which also pulls rotatable spacer 410 upward until the gap (corresponding to first travel distance X)

between the bottom of extension 436 and the top of rim 440 that existed in FIGS. 14 and 15 is closed. Locking tab 435 is now engaged with third notch 444.

Figure 17:
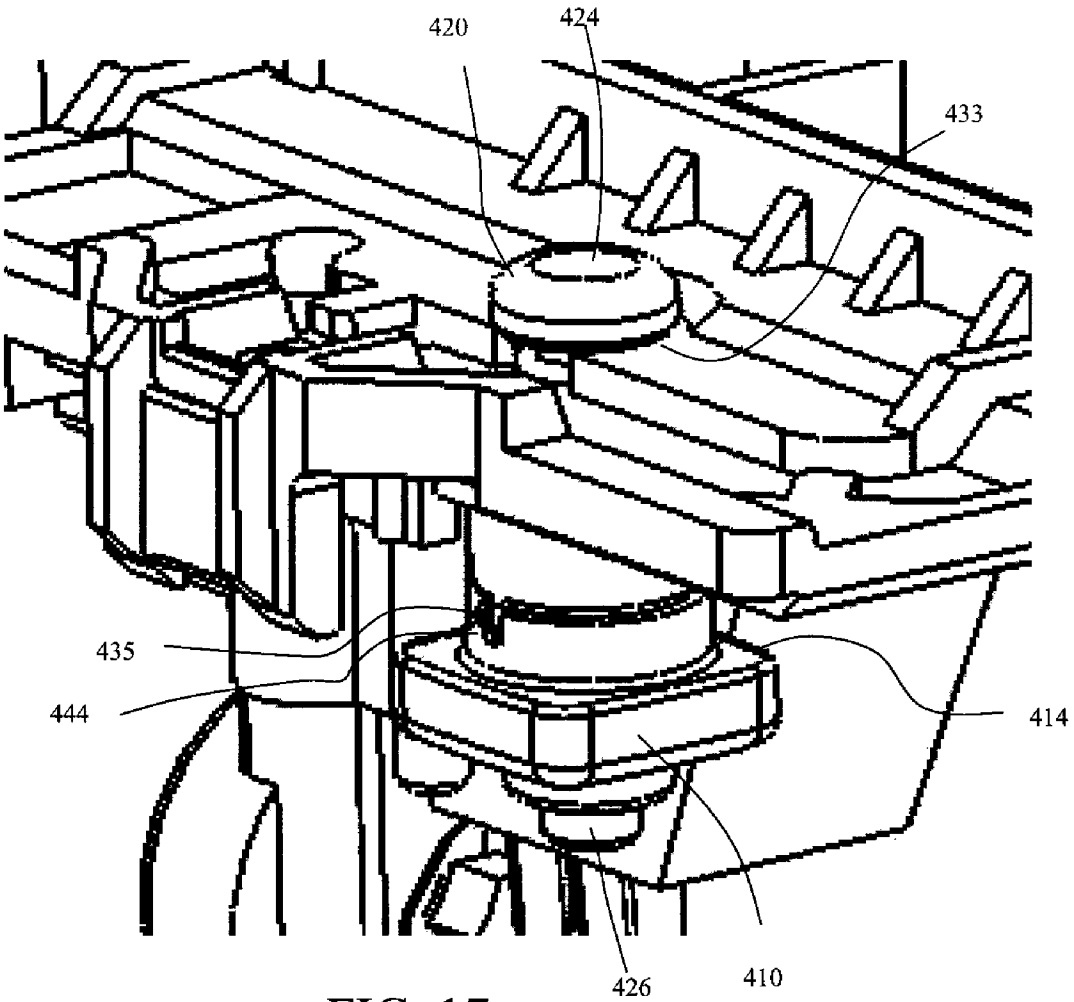
FIG. 17 shows the embodiment of FIG. 16 after the spring-loaded screw has been tightened.

Screw 420 is next tightened, without exerting sufficient hold-down force on screw head 424 to disengage locking tab 435 from the catch that it is currently in (third notch 444, in this case). FIG. 17 shows the result of tightening screw 420. Screw head 424 is held against collar 433. Screw end 426 extends past rotatable spacer 410. Locking tab 435 is firmly engaged in notch 444. The tightened screw 420 keeps locking tab 435 from being disengaged. Adjustment of spacing D between printhead nozzle face 252 and media support 301 is now completed and locked in, such that D is now within the acceptable range of spacings.

Thus, a simple adjustment mechanism and method has been provided for setting a spacing between the printhead and the media support after the printer has been assembled in the factory, and for locking the setting in place.

The invention has been described in detail with particular reference to certain preferred embodiments thereof but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Printhead die substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
205 Carriage bushing(s)
210 Carriage rotation direction
250 Printhead chassis
251 Printhead die
252 Printhead nozzle face
253 Nozzle array(s)
254 Nozzle array direction
256 Encapsulant
257 Flex circuit
258 Connector board
262 Multi-chamber ink supply
264 Single-chamber ink supply
300 Printer chassis
301 Media support
302 Paper load entry direction
303 Print region
304 Media advance direction
305 Carriage scan axis direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller(s)
324 Discharge roller
325 Star wheel(s)
330 Maintenance station
370 Stack of media
371 Top piece of medium
380 Carriage motor
382 Carriage guide rail
383 Anti-rotation rail
384 Belt
385 Encoder fence
390 Printer electronics board
392 Cable connectors
410 Rotatable spacer
411 Threaded hole
412 First contact face
413 Second contact face
414 Third contact face
420 Rotatable member (screw)
422 Compression spring
424 Screw head
425 Bias direction
426 Screw end
428 Rotation direction
431 Axis of rotation
432 Direction from rotation axis to anti-rotation rail
433 Collar
434 Ledge
435 Locking tab
436 Extension
438 Hole
440 Rim
442 First notch
443 Second notch
444 Third notch
447 First stopper
448 Second stopper
449 Short wall(s)
450 Lockable adjustment mechanism

What is claimed is:

1. A method of setting a spacing between a portion of a printhead and a portion of a media support in a printing system that includes a carriage with a locking tab, a guide rail for supporting the carriage as the carriage moves the printhead along a carriage scan axis, an anti-rotation rail for limiting an amount of rotation of the carriage around the guide rail, and a rotatable spacer including a plurality of contact faces for contacting the anti-rotation rail and a plurality of catches for engaging the locking tab, the method comprising:

a) assembling the printing system such that a first contact face of the rotatable spacer is in contact with the anti-rotation rail and the locking tab is engaged in a first catch;

b) measuring the spacing between the portion of the printhead and the portion of the media support; and c) selecting which face of the rotatable spacer will be in contact with the anti-rotation rail, depending upon the measured spacing between the portion of the printhead and the media support, including determining whether the spacing between the portion of the printhead and the media support is within an acceptable range and selecting one of the following steps d), e) or f):

d) keeping the first contact face of the rotatable spacer in contact with the anti-rotation rail if the measured spacing is within the acceptable range;

e) rotating the rotatable spacer such that a second contact face of the rotatable spacer is in contact with the anti-rotation rail if the measured spacing is less than the acceptable range; or f) rotating the rotatable spacer such that a third contact face of the rotatable spacer is in contact with the anti-rotation rail if the measured spacing is greater than the acceptable range.

2. The method of claim 1, wherein rotating the rotatable spacer further comprises:

g) releasing the locking tab from the first catch; and h) rotating the rotatable spacer until the locking tab is engaged in a catch that is different from the first catch.

3. The method of claim 2, wherein step g) further comprises loosening a spring-loaded screw.

4. The method of claim 2, wherein step h) further comprises rotating the rotatable spacer until the locking tab interferes with a stopper.

5. The method of claim 2, wherein step h) further comprises tightening a spring-loaded screw.

6. The method of claim 1, wherein step e) further includes rotating the rotatable spacer in a first rotational direction, and step f) further includes rotating the rotatable spacer in a rotational direction that is opposite the first rotational direction.

7. A method for fixing a distance between a printhead and a media support in a printer, the method comprising the steps of:

forming a printhead support on a carriage;

attaching an elongated guide rail to the printer;

attaching the carriage to the elongated guide rail such that the carriage is capable of freely rotating at least partially around the guide rail, is supported by the guide rail, and is capable of moving along a length of the guide rail;

coupling a lockable rotatable spacer to the carriage, the lockable rotatable spacer having a central axis and a plurality of contact points, the plurality of contact points each disposed at a different distance from the central axis, the lockable rotatable spacer capable of being locked in a non-rotatable position;

attaching an anti-rotation rail to the printer; and abutting a selected one of the plurality of contact points against the anti-rotation rail for fixing a distance between the central axis and the anti-rotation rail, said one of the plurality of contact points being selected by rotating the rotatable spacer, the distance between the central axis and the anti-rotation rail corresponding to the distance between the printhead and the media support; and determining whether the distance between the printhead and the media support in the printer would be within an acceptable range;

in response to determining that the distance between the printhead and the media support in the printer would be within the acceptable range, not rotating the rotatable spacer, including the step of: in response to determining that the distance between the printhead and the media support in the printer would not be within the acceptable range, rotating the rotatable spacer until the distance between the printhead and the media support in the printer would be within the acceptable range.

8. The method of claim 7, further comprising the step of forming a locking tab on the carriage, wherein the rotatable spacer further comprises a catch for engaging the locking tab and for preventing the rotatable spacer from rotating unintentionally, the catch corresponding to one of the contact points abutting against the anti-rotation rail.

9. The method of claim 7, further comprising the step of forming a locking tab on the carriage, wherein the rotatable spacer further comprises a plurality of catches each for engaging the locking tab and each for preventing the rotatable spacer from rotating unintentionally, each of the catches corresponding to one of the contact points abutting against the anti-rotation rail.

10. The method of claim 9, further comprising the step of rotating the rotatable spacer to engage a selected one of the catches with the locking tab, thereby selecting one of the contact points abutting against the anti-rotation rail, fixing the distance between the central axis and the anti-rotation rail, and fixing the distance between the printhead and the media support.

11. The method of claim 7, wherein each of the contact points comprises a planar face on the lockable rotatable spacer.

12. The method of claim 7, further comprising the steps of:

measuring the distance between the printhead support and the media support in the printer; and selecting which one of the plurality of contact points will abut the anti-rotation rail, in response to the step of measuring, for fixing a distance between the central axis and the anti-rotation rail.

13. The method of claim 7, wherein the steps of rotating the rotatable spacer each include rotating the rotatable spacer in a clockwise direction or in a counter-clockwise direction around the central axis.

14. The method of claim 9, further comprising the steps of releasing the locking tab from one of the plurality of catches and rotating the rotatable spacer until the locking tab engages another one of the plurality of catches.

15. The method of claim 14, further comprising the step of loosening a spring-loaded screw before releasing the locking tab from one of the plurality of catches.

16. The method of claim 14, further comprising the step of tightening a spring-loaded screw after the locking tab engages another one of the plurality of catches.

17. The method of claim 8, wherein the step of rotating the rotatable spacer further comprises the step of rotating the rotatable spacer until the locking tab interferes with a stopper.

18. The method of claim 7, further comprising the steps of:

attaching the printhead to the printhead support;

measuring the distance between the printhead and the media support in the printer; and selecting which one of the plurality of contact points will abut the anti-rotation rail, in response to the step of measuring, for fixing a distance between the central axis and the anti-rotation rail.

19. A method for fixing a distance between a printhead and a media support in a printer, the method comprising the steps of:

forming a printhead support on a carriage;

attaching an elongated guide rail to the printer;

attaching the carriage to the elongated guide rail such that the carriage is capable of freely rotating at least partially around the guide rail, is supported by the guide rail, and is capable of moving along a length of the guide rail;

coupling a lockable rotatable spacer to the carriage, the lockable rotatable spacer having a central axis and a plurality of contact points, the plurality of contact points each disposed at a different distance from the central axis, the lockable rotatable spacer capable of being locked in a non-rotatable position;

attaching an anti-rotation rail to the printer;

abutting a selected one of the plurality of contact points against the anti-rotation rail for fixing a distance between the central axis and the anti-rotation rail, said one of the plurality of contact points being selected by rotating the rotatable spacer, the distance between the central axis and the anti-rotation rail corresponding to the distance between the printhead and the media support;

forming a locking tab on the carriage, wherein the rotatable spacer further comprises a plurality of catches each for engaging the locking tab and each for preventing the rotatable spacer from rotating unintentionally, each of the catches corresponding to one of the contact points abutting against the anti-rotation rail;

releasing the locking tab from one of the plurality of catches;

rotating the rotatable spacer until the locking tab engages another one of the plurality of catches; and loosening a spring-loaded screw before releasing the locking tab from one of the plurality of catches.

20. The method of claim 19, further comprising the step of rotating the rotatable spacer to engage a selected one of the catches with the locking tab, thereby selecting one of the contact points abutting against the anti-rotation rail, fixing the distance between the central axis and the anti-rotation rail, and fixing the distance between the printhead and the media support.

21. The method of claim 19, wherein each of the contact points comprises a planar face on the lockable rotatable spacer.

22. The method of claim 19, further comprising the steps of:

measuring the distance between the printhead support and the media support in the printer; and selecting which one of the plurality of contact points will abut the anti-rotation rail, in response to the step of measuring, for fixing a distance between the central axis and the anti-rotation rail.

23. The method of claim 19, further comprising the step of tightening a spring-loaded screw after the locking tab engages another one of the plurality of catches.

24. The method of claim 19, wherein the step of rotating the rotatable spacer further comprises the step of rotating the rotatable spacer until the locking tab interferes with a stopper.

25. The method of claim 19, further comprising the steps of attaching the printhead to the printhead support;

measuring the distance between the printhead and the media support in the printer; and selecting which one of the plurality of contact points will abut the anti-rotation rail, in response to the step of measuring, for fixing a distance between the central axis and the anti-rotation rail.

* * * * *